US006536134B1

(12) United States Patent
Villarreal

(10) Patent No.: US 6,536,134 B1
(45) Date of Patent: Mar. 25, 2003

(54) DRIER FOR COMMERCIAL PRINTERS

(75) Inventor: Jose A. Villarreal, Kemp, TX (US)

(73) Assignee: Graphic Specialists, Inc., Kemp, TX (US)

( * ) Notice: Subject to any disclaimer, the term of this patent is extended or adjusted under 35 U.S.C. 154(b) by 8 days.

(21) Appl. No.: 09/940,920

(22) Filed: Aug. 28, 2001

(51) Int. Cl.[7] ..... F26B 3/34

(52) U.S. Cl. ..... 34/266; 34/267; 34/273; 34/620; 34/218

(58) Field of Search ..... 34/245, 266, 267, 34/274, 611, 618, 620, 201, 218, 273

(56) References Cited

U.S. PATENT DOCUMENTS 3,914,594 A * 10/1975 Helding ..... 362/218
4,809,608 A * 3/1989 Wolnick et al. ..... 101/416.1
5,010,659 A * 4/1991 Treleven ..... 34/269
5,060,572 A * 10/1991 Waizmann ..... 101/424.1
5,317,127 A * 5/1994 Brewster et al. ..... 219/388
5,447,566 A * 9/1995 Loiacono ..... 118/249
5,908,000 A * 6/1999 Spychalla et al. ..... 101/487
5,966,836 A * 10/1999 Valdez et al. ..... 34/448
6,088,931 A * 7/2000 Aylor et al. ..... 34/267
6,354,015 B1 * 3/2002 Ogasawara et al. ..... 34/60

* cited by examiner

*Primary Examiner*—Ira S. Lazarus
*Assistant Examiner*—Andrea M. Ragonese
(74) *Attorney, Agent, or Firm*—Michael A. O'Neil

(57) ABSTRACT

A drier for commercial printers comprises an air receiving and discharging member having end walls, side walls, and a bottom wall and characterized by air receiving slots formed in the side walls and air discharging slots formed at the intersections between the side walls and the bottom wall. A lamp support frame having an imperforate top wall is positioned within the air receiving and discharging member. A fan support plate positions a fan above the top plate of the lamp frame for directing air onto the top plate thereof then downwardly along the side walls of the air receiving and discharging member and out through the air discharging slots thereof.

1 Claim, 4 Drawing Sheets

DRIER FOR COMMERCIAL PRINTERS

TECHNICAL FIELD

This invention relates generally to driers of the type utilized in the commercial printing industry, and more particularly to an infrared drier for commercial printers which is characterized by a simplified design that is economical to manufacture and by an improved air receiving and discharging system.

BACKGROUND AND SUMMARY OF THE INVENTION

In the commercial printing industry, driers are utilized immediately following the application of printing ink to a surface. The function of the drier is to apply infrared energy to the just-applied printing ink thereby evaporating the volatiles from the printing ink without adversely affecting either the remaining pigment component of the printing ink or the surface to which the printing ink has been applied. In this manner the drier functions to rapidly and efficiently prepare the printed material for further operations such as folding, cutting, stacking, etc.

Various drier designs have heretofore been utilized in the commercial printing industry. In general, prior art driers for commercial printers have been complicated in design and have therefore been relatively expensive to manufacture and use. For example, many prior art driers employ a cover as the main structural component upon which all other components are mounted. The cover-mounted approach is cumbersome and involves difficulty in the installation of wiring, etc.

The present invention comprises a drier for commercial printers which overcomes the foregoing and other problems which have long since characterized the prior art. In accordance with the broader aspects of the invention, an air receiving and directing member serves as the cover for the drier. A lamp support frame comprises the primary structural element of the drier and supports a plurality of infrared radiation generating lamps which function to direct infrared radiation directly onto an underlying service having fresh printing ink received thereon. The lamp support frame has a reflector secured thereto which reflects radiation from the lamps onto the printing ink bearing surface.

A fan support plate is supported on the lamp support frame and in a spaced apart relationship with respect to the top plate thereof. The fan support plate supports one or more fans and is provided with an air directing aperture aligned with each fan. The fans direct air through the apertures of the fan support plate and onto the upper surface of the top plate of the lamp supporting bracket. The air then flows around the ends of the lamp support frame and is directed onto the print bearing surface through apertures formed in the air receiving and directing member. Additional air is received through apertures formed in the sides of the air receiving and directing member.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1A:
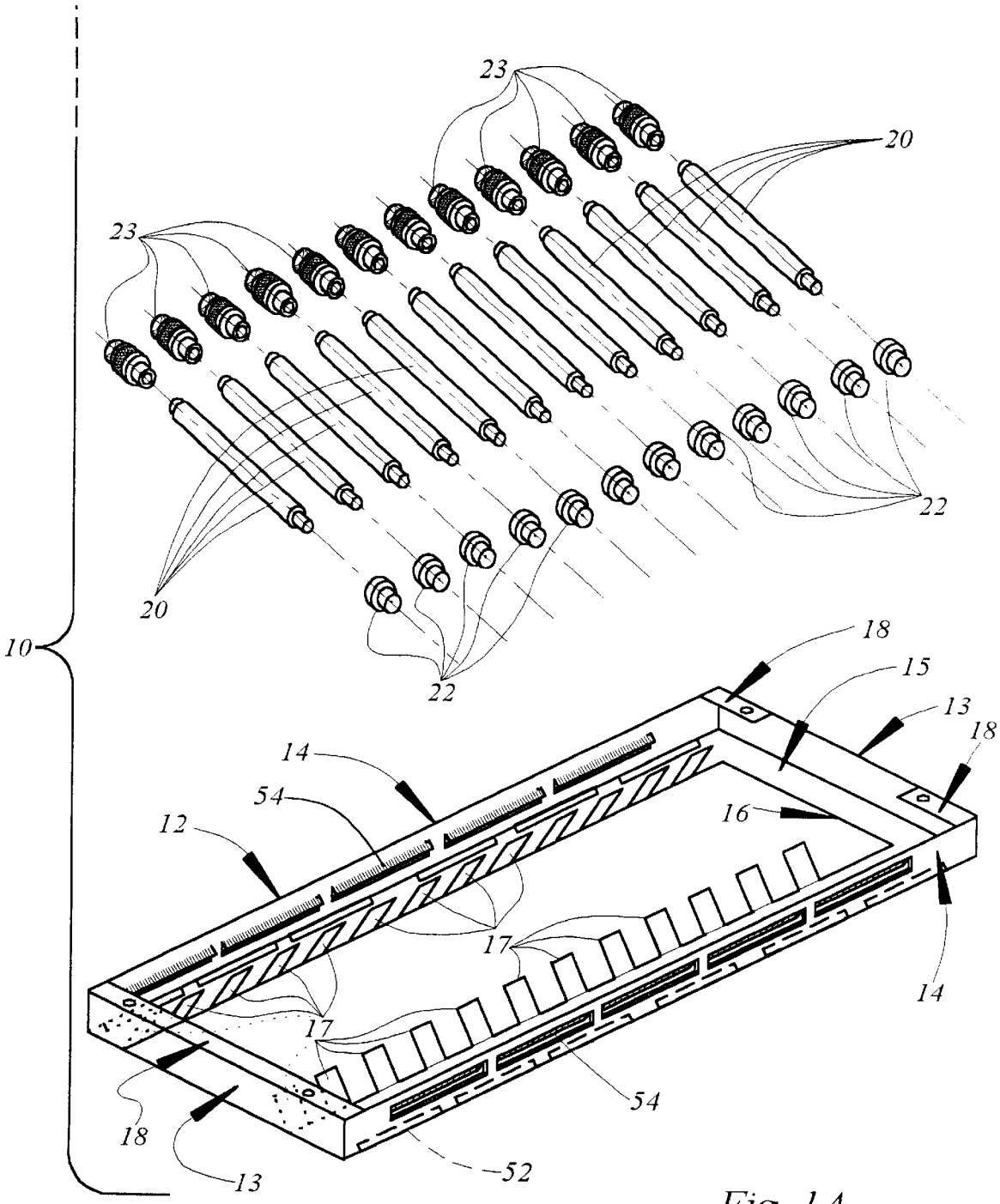
FIG. 1A is an exploded perspective view of a drier for commercial printers comprising the preferred embodiment of the present invention.

Referring now to the Drawings, and particularly to FIG. 1 thereof, there is shown a drier for commercial printers 10 comprising the preferred embodiment of the invention. The drier 10 includes an air receiving and directing member 12 comprising a rectangular structure defined by end walls 13 and side walls 14. A partial bottom wall 15 extends inwardly from the end walls 13 and the side walls 14 to define a rectangular light directing aperture 16. A plurality of tabs 17 extend angularly upwardly and inwardly from the bottom wall 15 relative to the aperture 16. A plurality of partial top walls 18 extend inwardly from the end walls 13 and have fastener receiving holes formed therein.

The drier 10 further comprises a plurality of infrared radiation generating lamps 20. The lamps 20 are of type having electrical terminals at the opposite ends thereof. The opposite ends of each lamp are received in a receptacle 22 and in a spring loaded receptacle 23, respectively. The receptacles 22 and 23 function as electrical connectors to the terminals of the lamps 20.

Figure 1B:
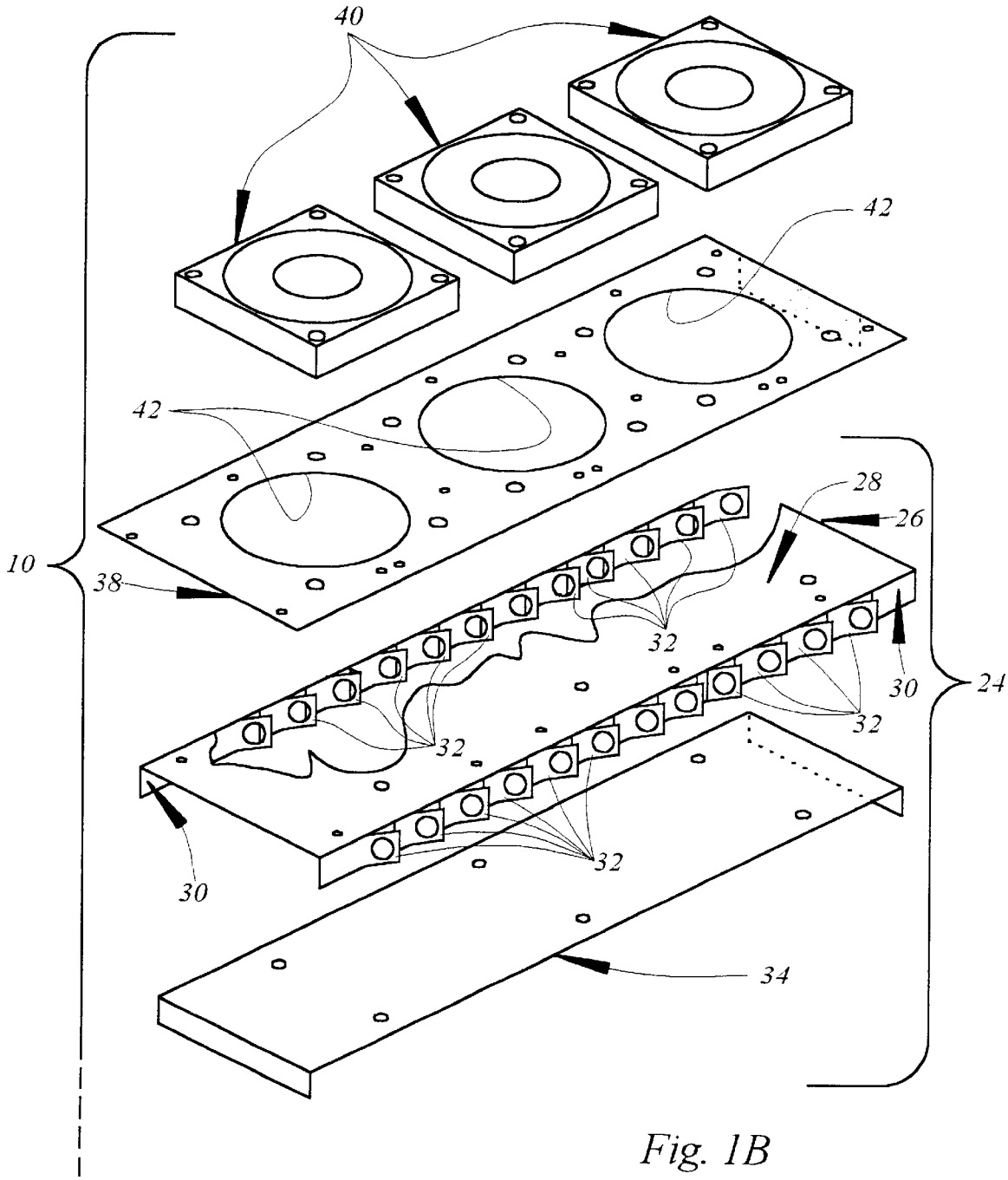
FIG. 1B is a continuation of FIG. 1A.

Referring to FIG. 1B, receptacles 22 and 23 and therefore the lamps 20 are mounted on a lamp support frame 24 which comprises the primary structural component of the drier 10. The lamp support frame 24 comprises an upper member 26 having a substantially imperforate top panel 28, the only perforations in the top panel 28 being fastener receiving holes which are filled when assembly of the drier 10 is complete.

A pair of opposed side walls 30 extend downwardly from the panel 28. The side walls 30 comprise a plurality of angularly extending lamp support brackets 32. The brackets 32 are arranged in opposed pairs, each of the opposed pairs of brackets 32 receiving and supporting an opposed pair of receptacles 22 and 23 which receive and support a lamp 20 therebetween.

The lamp support frame 24 further includes a reflector plate 34 which is secured to the underside of the panel 28 of the frame 24. The surface of the reflector plate 34 which faces the lamps 20 is mirrored. The reflector plate 34 therefore serves to reflect infrared radiation generated by the lamps 20 through the aperture 16 of the air receiving and directing member 12.

The drier 10 further includes a fan support plate 38. One or more fans 40 are supported on the fan support plate 38. The fan supporting plate 40 has one or more large air directing apertures 42 formed therein. The apertures 42 are equal in number to and aligned with the fans 40.

Figure 2:
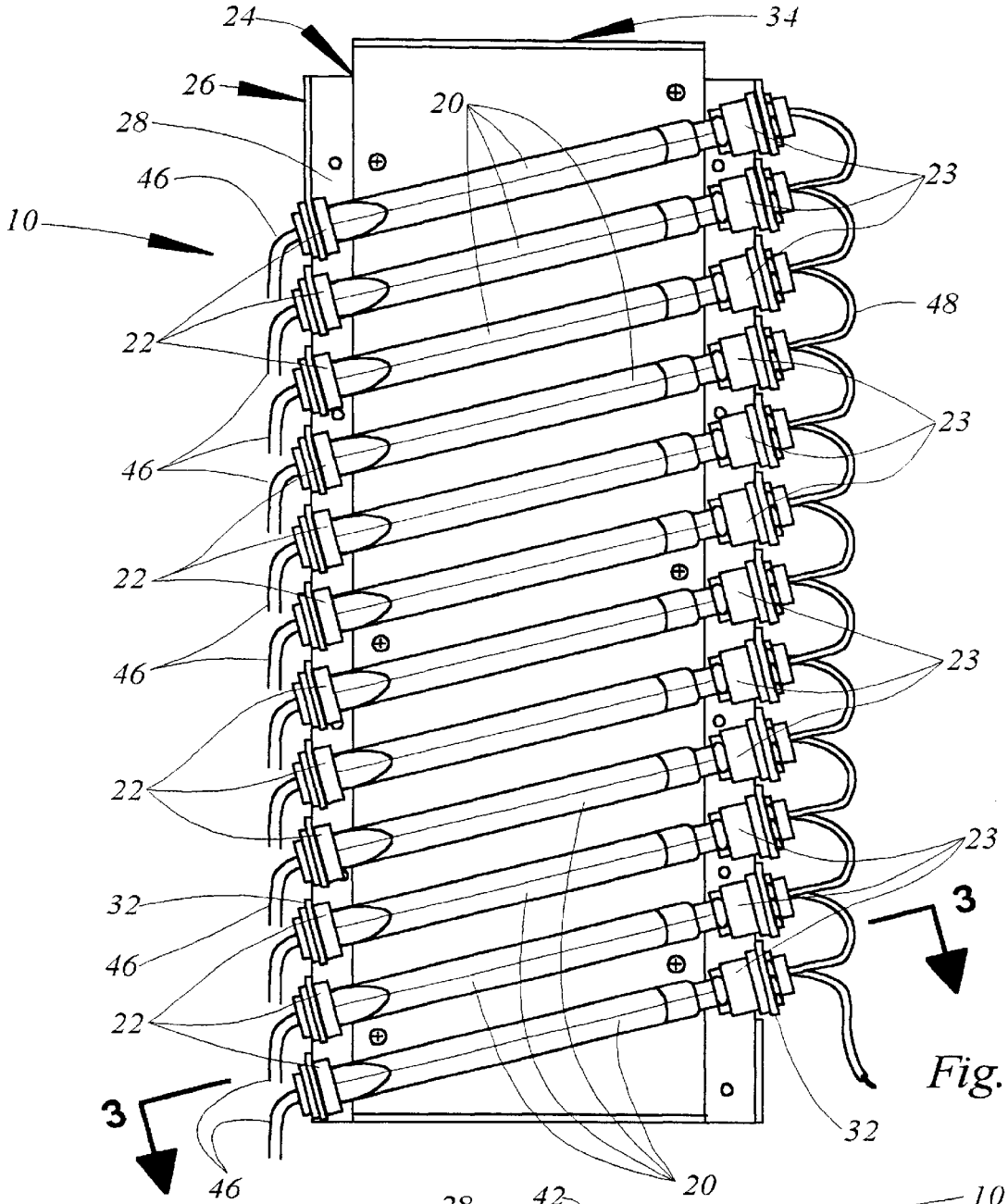
FIG. 2 is a bottom view illustrating the lamps and the lamp support frame of the drier of FIG. 1.

In the assembly of the drier 10, the fans 40 are secured to the fan support plate 38 and to the lamp support frame 24 by fasteners extending through aligned fastener receiving apertures formed in the fan 40, the fan support plate 38, and the lamp support frame 24. The fan support plate 38 is positioned in a spaced apart relationship relative to the top panel 28 of the upper member 26 of the lamp support frame 24 by spacers 44 positioned therebetween. As is best shown in FIG. 2, a plurality of individual electrical leads 46 extend to each of the receptacles 22 while a common electrical lead 48 extends to all of the receptacles 23.

Figure 3:
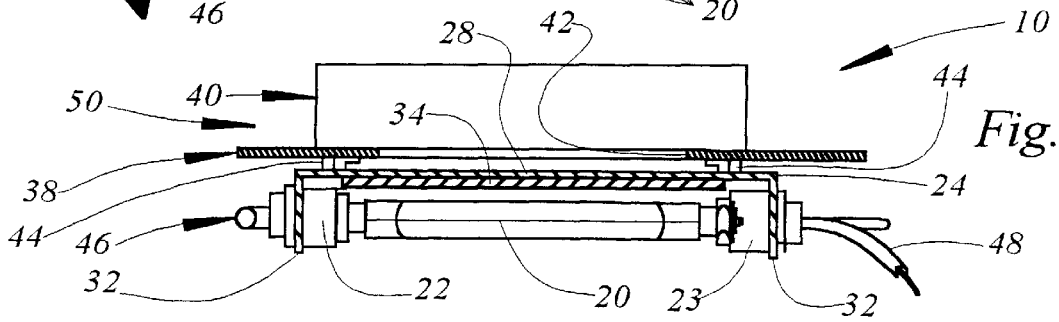
FIG. 3 is a sectional view taken along the line 3—3 in FIG. 2 in direction of the arrows.

FIG. 3 illustrates a subassembly 50 comprising the lamps 20, the receptacles 22 and 23, the lamp support frame 24, the fan support plate 38, the fans 40, the spacers 44 and the electrical leads 46 and 48. An important feature of the present invention comprises the fact that the subassembly 50 can be completely assembled prior to the mounting of any of the components of the drier 10 within the air receiving and directing member 12. In this manner the completion of the subassembly 50 proceeds rapidly and efficiently and is not encumbered by the necessity of working around the component parts of the air receiving and directing member 12 which serves as a housing for the drier 10.

Figure 4:
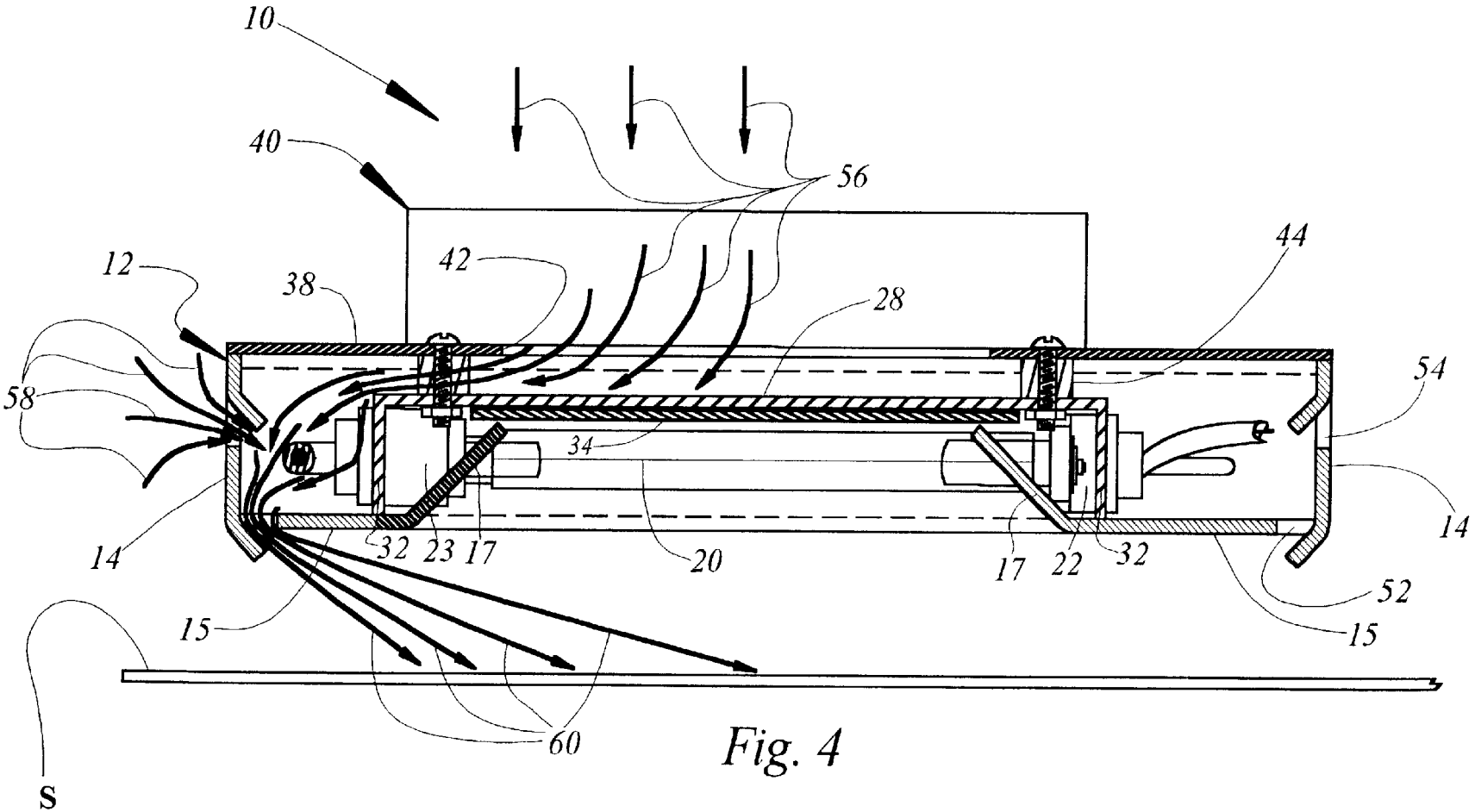
FIG. 4 is a transverse sectional view of the drier of FIG. 1 further illustrating the construction and operation thereof.

The operation of the drier 10 is illustrated in FIG. 4. A plurality of air discharging slots 52 are formed in the air receiving and directing member 12 at the intersections between the side walls 14 and the bottom wall 15. A plurality of air receiving slots are formed at spaced apart locations in the side walls 14.

Arrows 56 illustrate the flow of air through the fans 40, across the top panel 28 of the upper member 26 of the lamp support frame 24, around the ends of the lamp support frame 24, and outwardly through air discharging slots 52 formed at the intersection between the side walls 14 and the bottom wall 15 of the air receiving and discharging member 12. As the air passes across the top panel 28, it is substantially heated and therefore increases in velocity. As the air passes the inwardly disposed tabs defining the slots 54 formed in the side walls 14, a venturi effect is achieved. As is indicated by the arrows 58, this causes additional air to enter the air receiving and discharging member 12 which is combined with the air flowing therethrough under the action of the fans 40. The air discharged from the air discharging slots 52 is directed onto an underlying surface S having printing ink received thereon as indicated by the arrows 60. The printing ink is rapidly dried under the action of the radiation from the lamps 20 and the heated air discharged from the air discharging slots 52 of the air receiving and discharging member 12. As will be appreciated by those skilled in the art, the arrows 56, 58, and 60 are shown on one side only of FIG. 4 for clarity.

It will therefore be understood that the present invention comprises a drier for commercial printers which is composed of a relatively small number of easily manufactured parts. The operating components of the drier are readily and economically assembled to form a subassembly which is thereafter installed in the air receiving and discharging member of the drier. The air receiving and discharging member functions as an air knife which directs heated air flowing under the action of fans and additional air which is combined with the fan driven air by venturi action onto the printing ink on the underlying surface.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A drier for commercial printers comprising:

an air receiving and directing member comprising opposed side walls interconnected by opposed end walls, the side walls and the end walls having aligned top and bottom edges;

a bottom wall extending inwardly from the bottom edges of the side walls and the end walls and having a rectangular light directing aperture formed therein and a plurality of tabs extending inwardly and upwardly relative to the light directing aperture;

the side walls each comprising a plurality of air discharging slots located at the intersections between the side walls and the bottom wall and having a plurality of air receiving slots formed therein at points located substantially midway between the top and bottom edges of the side walls;

a lamp support frame positioned between the side walls of the air receiving and directing member and in engagement with the bottom wall thereof;

the lamp support frame comprising a substantially imperforate top plate having a reflective surface formed on the underside thereof for reflecting infrared energy through the rectangular aperture of the air receiving and directing member;

a fan support plate mounted on the upper edges of the side walls of the air receiving and directing member and positioned above and in a spaced apart relationship with respect to the top plate of the lamp support frame and having at least one large air directing aperture extending therethrough;

at least one fan mounted on the fan support plate in alignment with the air directing aperture formed therethrough for directing air flow through the large aperture of the fan support plate and onto the upper surface of the top plate of the lamp support frame then outwardly toward the side walls of the air receiving and discharging member for discharge through the air discharge slots formed at the intersection between the side walls and the bottom wall of the air receiving and discharging member; and additional air entering the air receiving and discharging member through the slots formed in the side walls thereof for discharge through the air discharging slots together with the air received from the fan.

* * * * *

UNITED STATES PATENT AND TRADEMARK OFFICE

CERTIFICATE OF CORRECTION

PATENT NO. : 6,536,134 B1
DATED : March 25, 2003
INVENTOR(S) : Villarreal

It is certified that error appears in the above-identified patent and that said Letters Patent is hereby corrected as shown below:

Column 2,
Line 54, replace “plate 40” with -- plate 38 --.

Column 4,
Line 7, replace “commercial printers” with -- drying printing ink in commercial printers --.
Line 19, replace “the intersections” with -- intersections --.
Line 29, replace “the underside” with -- an underside --.
Line 30, replace “through the rectangular aperture of the” with
-- from at least one infrared lamp through the rectangular aperture of the --.
Line 31, replace “directing member” with -- directing member directly onto printing ink --.
Line 40, replace “the large” with -- the large air directing --.
Line 41, replace “the upper” with -- an upper --.
Line 45, replace “the intersection” with -- an intersection --.
Line 50, replace “the slots” with -- the air discharging slots --.
Line 52, replace “the air” with -- air --.

Signed and Sealed this

Twenty-sixth Day of August, 2003

JAMES E. ROGAN
*Director of the United States Patent and Trademark Office*